United States Patent [19]

Ellwood

[11] Patent Number: 4,947,936

[45] Date of Patent: Aug. 14, 1990

[54] WELL UNIT DYNAMOMETER INSTALLATION MEANS AND METHOD

[75] Inventor: David E. Ellwood, Iraan, Tex.

[73] Assignee: Marathon Oil Company, Findlay, Ohio

[21] Appl. No.: 366,565

[22] Filed: Jun. 14, 1989

[51] Int. Cl.[5] ..... E21B 19/00; E21B 41/00

[52] U.S. Cl. ..... 166/379; 166/75.1; 166/85; 166/105; 73/151; 417/63

[58] Field of Search ..... 166/66, 75.1, 76, 85, 166/105, 377, 379; 417/63; 73/151; 248/49, 58; 294/90, 91

[56] References Cited

U.S. PATENT DOCUMENTS

| | | | |
|---|---|---|---|
| 2,741,915 | 4/1956 | Renken et al. | 73/151 |
| 3,251,310 | 5/1966 | Wittwer et al. | 417/63 |
| 3,306,210 | 2/1967 | Boyd et al. | 103/25 |
| 3,343,409 | 9/1967 | Gibbs | 73/151 |
| 3,355,938 | 12/1967 | Neely et al. | 73/141 |
| 3,359,791 | 12/1967 | Pantages | 73/151 |
| 3,499,324 | 3/1970 | Wenisch | 73/151 |
| 3,527,094 | 9/1970 | Yew et al. | 73/151 |
| 3,965,736 | 6/1976 | Welton | 73/151 |
| 4,483,564 | 11/1984 | McDaniel | 294/91 |
| 4,850,736 | 7/1989 | Petrie | 403/344 |

*Primary Examiner*—Bruce M. Kisliuk

*Attorney, Agent, or Firm*—Jack L. Hummel; Jack E. Ebel

[57] ABSTRACT

A well unit dynamometer installation means and method. A reciprocal well unit is operated with a spacer mounted on the polish rod above the carrier bar. To install a dynamometer the unit is stopped, the loading removed from the carrier bar, the spacer removed and the dynamometer attached to the polish rod above the carrier bar. The spacer comprises nested sleeves, each having a slot. The outer sleeve rotates with respect to the inner sleeve, allowing the slots to be aligned so as to be slipped over the polish rod. End plates connected to the inner sleeve allow operating loads to be transmitted through the spacer during operation of the well unit.

21 Claims, 3 Drawing Sheets

WELL UNIT DYNAMOMETER INSTALLATION MEANS AND METHOD

FIELD OF THE INVENTION

This invention relates to a well unit having a reciprocal rod string connected to a down hole pump, and to the measuring of the load on the rod string. More particularly, it relates to a method and means for providing adequate space on the polish rod section of the rod string on which to mount a load measuring device.

BACKGROUND OF THE INVENTION

It is common to periodically measure the load on the rod string of a well unit so that an analysis of the well characteristics and of the performance of the pumping unit can be made. This is normally done by mounting two different transducers to the pumping unit, one of which supplies a signal which is proportional to the vertical position of the pumping unit and the other of which supplies a signal which is proportional to the load on the rod string. The position transducer commonly is mounted on the polish rod of the rod string at a location below the carrier bar, while the quantitative load transducer is mounted on the polish rod between the polish rod clamp and the carrier bar.

The installation of the quantitative load transducer is difficult in situations where there is little space available on the polish rod to receive the transducer or to maneuver the rod in order to expose more of the rod. This problem is frequently encountered where there is a high wellhead completion, leaving little room between the wellhead and the pumping unit, and where the basic design of the pumping unit similarly leaves little room.

One solution to the problem has been to physically raise the entire pumping unit and install additional concrete bases beneath it to permanently maintain it in the raised position. This provides more exposed polish rod space but is an expensive method which is preferably to be avoided. Another solution has been to use a pulling unit t raise the rod and remove rod blow-out preventers. This is not only time consuming and expensive but is also potentially hazardous in that the removal of the rod blow-out preventers allows gas from the well to escape. Another solution has been to raise the polish rod clamp, while still secured to the polish rod, a sufficient distance to allow the transducer to be inserted on the polish rod at a location above the carrier bar. After running the dynamometer survey the transducer has been removed and the clamp moved to its original position.

Although the latter method is normally preferred over the other methods mentioned, it also has definite drawbacks. It is time consuming to move the polish rod clamp as required, which allows the well to recover. Thereafter, the well must be monitored until it has stabilized, with the result that the time required for this entire procedure can be a great deal longer than the time it would normally take to run the dynamometer. Moreover, it cannot be employed in the situation wherein there is insufficient room between the carrier bar, the liner nut and the stuffing box to enable the polish rod clamp to be lifted the necessary distance to enable the transducer to be inserted. In addition, even in cases where the clamp can be lifted a sufficient amount, by doing so the pump attached to the rod string is lifted a like distance, with the result that the test is run with the pump plunger in a higher than normal position in the pump barrel, which can have an effect on the dynamometer results.

It would be desirable to be able to quickly and conveniently install a dynamometer transducer on the polish rod of a well unit which does not have sufficient room between the carrier bar and the elements on the rod beneath it to normally allow this to be accomplished.

SUMMARY OF THE INVENTION

In accordance with the invention spacer means are provided on the polish rod between the carrier bar and the polish rod clamp. The spacer means includes means for vertically transmitting well unit operating loads and means allowing the spacer means to be installed on and removed from the polish rod. The well unit is operated with the spacer means installed on the polish rod, and the spacer means is removed when it is desired to run a dynamometer test. To run the test it is merely necessary to insert the load measuring means onto the polish rod in the space vacated by the spacer means, thereby greatly reducing the time for the installation of the transducer and allowing the test to be run with the rod clamp and the pump plunger in their original operating positions.

Preferably, the means on the spacer for vertically transmitting well unit operating loads comprises upper and lower end plates which are in contact with adjacent load bearing surfaces mounted on the polish rod and a vertically arranged sleeve connecting the end plates. The means for allowing ready installation and removal of the spacer preferably comprises nesting sleeves, the outer sleeve being mounted for rotational movement about a fixed inner sleeve and both sleeves containing longitudinal slots which permit insertion or removal when they are aligned and which prevent removal when they are nonaligned. The outer sleeve can be locked in place after the slot in the outer sleeve has been rotated to its nonaligned position.

Other features and aspects of the invention, as well as other benefits of the invention, will readily be ascertained from the more detailed description of the invention which follows.

DESCRIPTION OF THE PREFERRED EMBODIMENT

Figure 1:
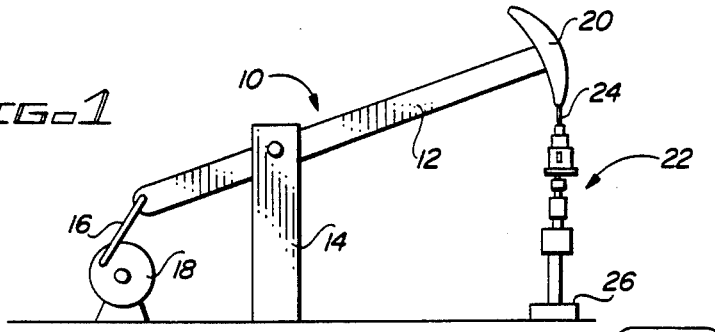
FIG. 1 is a simplified side elevation of a well pumping unit incorporating the spacer of the present invention.

Referring to FIG. 1, a typical well unit of the type to which the invention relates is indicated generally at 10. The unit comprises a walking beam 12 pivotally mounted on a support standard 14 and connected at one end to the connecting link 16 of a crank 18. The crank is moved by a suitable motor and gear box connection which is not shown since such an arrangement is well known in the art and does not constitute part of the invention.

The other end of the beam 12 carries the usual horsehead 20 which supports the rod string to which the polish rod section 22 is connected. The polish rod section is attached to the horsehead by the bridle or cable 24 and extends upwardly from the wellhead 26.

Figure 2:
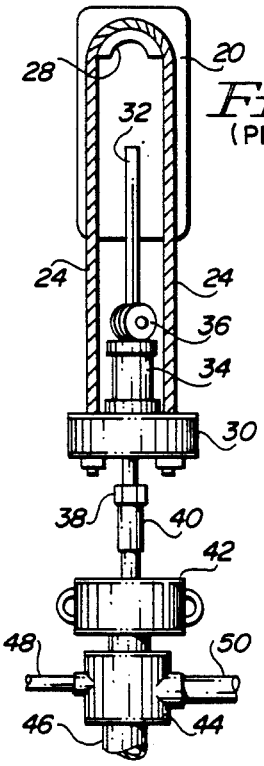
FIG. 2 (PRIOR ART)
FIG. 2 is a front elevation of the portion of the polish rod section extending up from the wellhead, showing a typical arrangement of elements prior to running a dynamometer test.

The elements carried by the polish rod section are shown in more detail in FIG. 2, which shows the cable 24 to be supported by the curved support 28 in the upper portion of the horsehead 20. The cable 24 supports a carrier bar 30 through which the polish rod 32 extends. The polish rod extends through a conventional rod rotator 34, the lower surface of which engages the carrier bar 30, and carries a conventional rod clamp 36, the lower surface of which engages the upper surface of the rod rotator. Mounted on the polish rod 32 a short distance beneath the carrier bar 30 is a liner nut 38 which holds the polish rod liner 40 in place. Mounted beneath the liner section is stuffing box 42, and located below the stuffing box is valve box 44 to which the well tubing 46 and delivery conduits 48 and 50 are connected. This arrangement is illustrative of the situation wherein the stuffing box and liner nut are clustered together substantially directly beneath the carrier bar, leaving little room for maneuvering a transducer into place.

Figure 3:
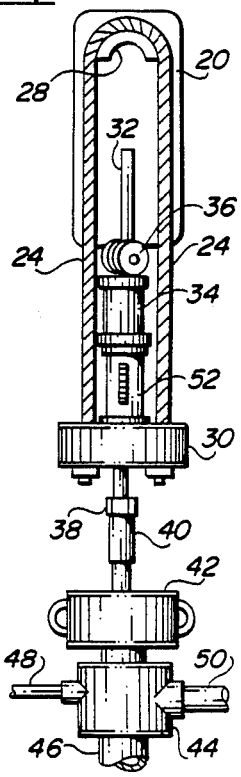
FIG. 3 (PRIOR ART)
FIG. 3 is a view similar to that of FIG. 2, but showing a transducer in place.

As shown in FIG. 3, during the running of a dynamometer load transducer test the transducer 52 is positioned between the carrier bar 30 and the rod rotator 34. It can be seen from the position of the liner nut 38 in FIG. 2, however, that there would not have been sufficient room to raise the clamp 36 and attached polish rod a distance equal to the length of the transducer 52. The use of the spacer of the present invention solves this problem.

Figure 4:
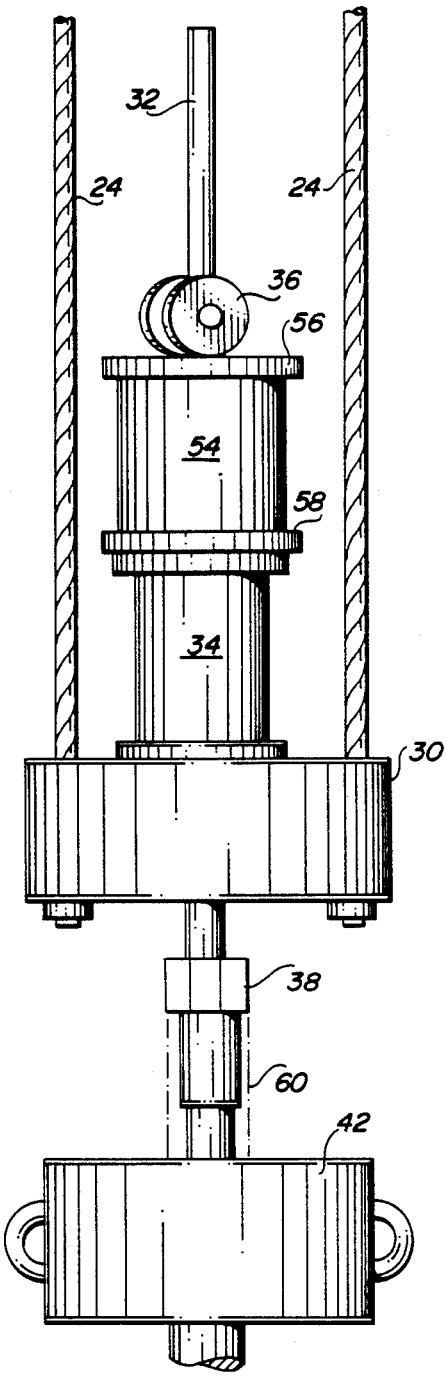
FIG. 4 is an enlarged partial elevational view of the polish rod with the spacer of the invention in place.
Figure 5:
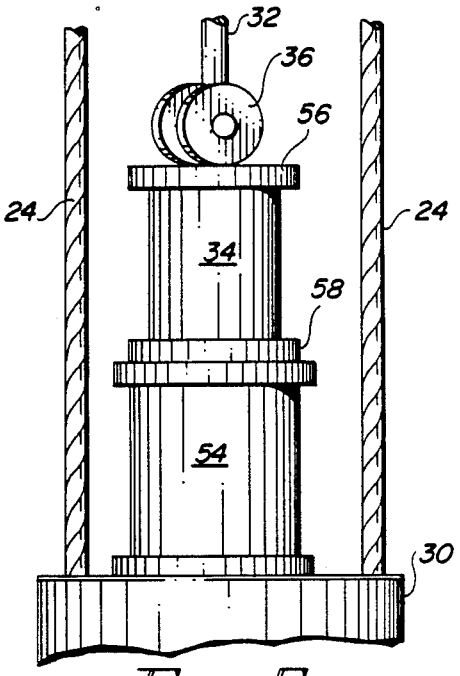
FIG. 5 is a view similar to that of FIG. 4, but showing the spacer in an alternate location.

Referring now to FIG. 4, a spacer 54 is shown positioned between the polish rod clamp 36 and the rod rotator 34. The spacer 54 will have been initially installed by using a pulling unit to hold the polish rod 32 in place while moving the clamp 36 up the rod to a location which allows room for the insertion of the spacer 54. The spacer remains in place during normal operation of the pump unit, with the vertical walls of the spacer and end plates 56 and 58 being structurally capable of transmitting vertical loads encountered during operation of the well unit. It will be understood that it is not necessary for the spacer to be located between the clamp 36 and the rod rotator 34 as shown in FIG. 4. The spacer may just as easily be located between the carrier bar 30 and the rod rotator 34, as illustrated in FIG. 5. The only requirement as to location of the spacer is that it be located above the carrier bar 30 and below the polish rod clamp 36.

Figure 6:
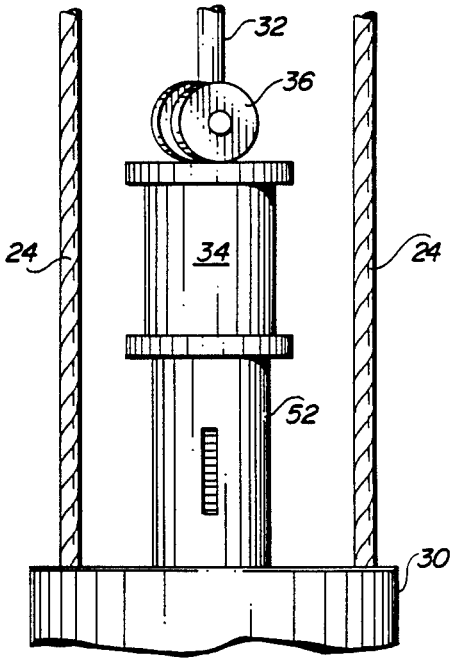
FIG. 6 is a view similar to that of FIG. 4, but showing the polish rod after the spacer has been replaced with a transducer.

As shown in FIG. 6, when it is desired to run a dynamometer test the spacer 54 is removed, leaving enough space on the polish rod for insertion of the transducer 52. The transducer 52 is shown in the position it would occupy during a test, which is between the carrier bar 30 and the rod rotator 34. In order to remove the spacer 54 another spacer or bumpstick 60, shown in broken lines in FIG. 4, is temporarily inserted between the liner nut 38 and the stuffing box 42. This relieves the load from the carrier bar 30, thus allowing the spacer 54 to be readily removed from the polish rod and the transducer 52 inserted. The same procedure would be followed whether the position of the spacer 54 is as shown in FIG. 4 or as shown in FIG. 5, except that in the FIG. 4 arrangement the rod rotator 34 would be slid up the polish rod 32 prior to inserting the transducer between the carrier bar and the rod rotator. If the well unit arrangement does not use a polish rod liner, a secondary clamp would be used in place of the liner nut 38 in order to provide an upper surface against which the temporary spacer 60 can abut.

Figure 7:
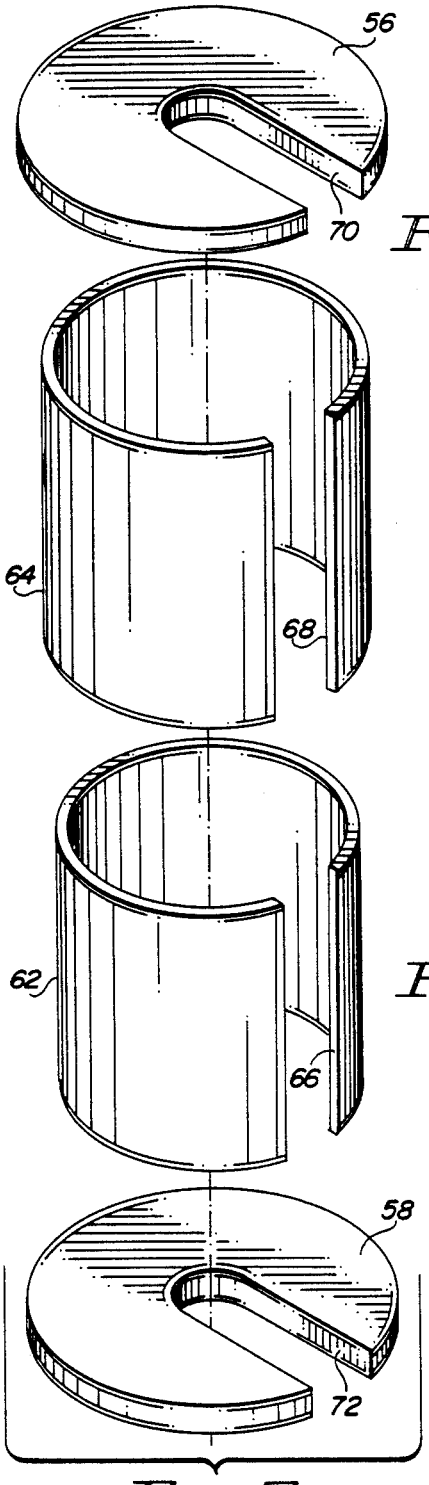
FIG. 7 is an exploded view of a preferred form of the spacer.

Referring now to FIG. 7, a preferred form of the spacer 54 is shown, consisting of the upper and lower end plates 56 and 58, and cylindrical inner and outer sleeves 62 and 64, respectively. The inner sleeve 62 contains a longitudinal slot 66 the width of which is at least slightly greater than the diameter of the polish rod so as to enable the sleeve to be moved to a position surrounding the rod. The outer sleeve 64 also contains a longitudinal slot 68 of a similar width to the slot 66. The upper and lower end plates 56 and 58 contain transversely extending slots 70 and 72, respectively, their widths being similar to the widths of the slots 66 and 68 and their lengths being sufficient to allow the plates to be centered about the polish rod.

Figure 8:
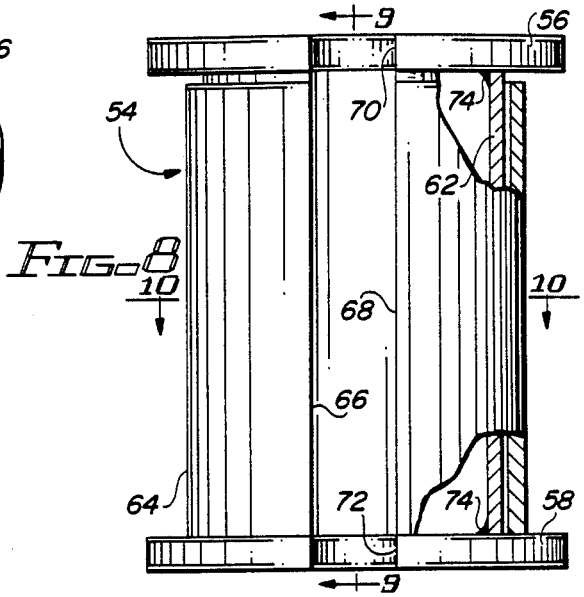
FIG. 8 is a side elevation of the spacer.
Figure 9:
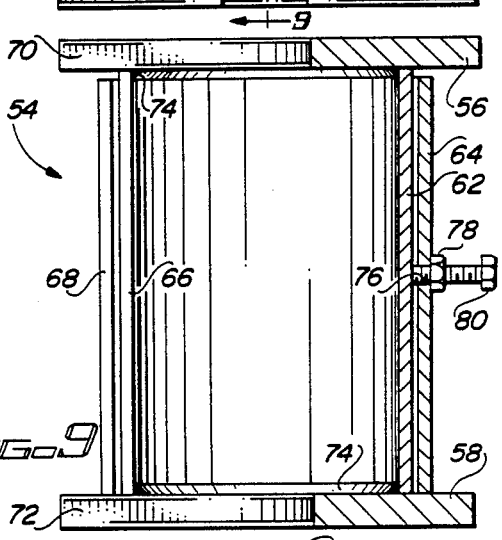
FIG. 9 is a longitudinal sectional view taken along line 9—9 of FIG. 8.
Figure 10:
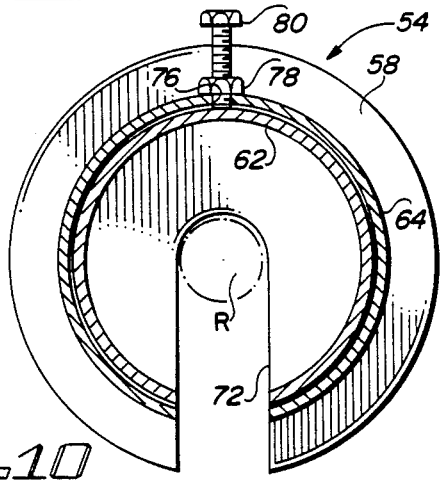
FIG. 10 is a transverse sectional view taken along line 10—10 of FIG. 8.

Referring to FIGS. 8, 9 and 10, the assembled spacer 4 is shown with the slots in all components being aligned and with the inner sleeve 62 being welded at its ends, as at 74, to the upper and lower plates 56 and 58. The inner sleeve 62 is slightly longer than the outer sleeve 64, which is unconnected to either the end plates or to the inner sleeve, allowing the outer sleeve to rotate about the inner sleeve. The outer sleeve contains an aperture 76 intermediate the end plates and a nut 78 attached as by welding so as to be aligned with the aperture 76. The threaded shank of a bolt 80 engages the nut 78 to allow the bolt to be run in toward and away from the inner sleeve, functioning as a set screw. The bolt 80 is not engaged with the inner sleeve in FIGS. 9 and 10. The spacer would be transversely moved into functioning position by having all the slots aligned. The slots 70 and 72 would be of a length to enable the spacer 54 to be centered on the polish rod in the manner shown in FIG. 10, wherein the polish rod is illustrated in broken lines at R.

Figure 11:
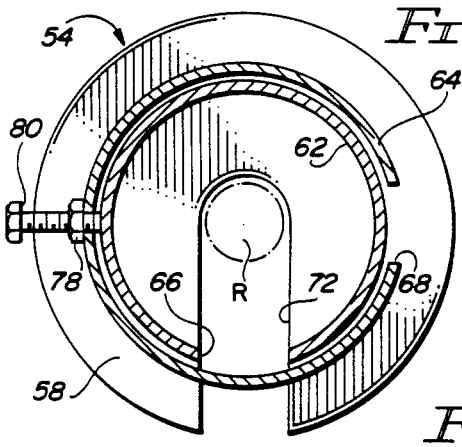
FIG. 11 is a view similar to that of FIG. 10, but showing the slots in the sleeves in one possible nonaligned position.
Figure 12:
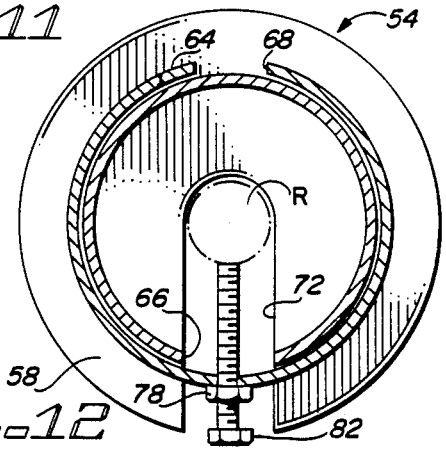
FIG. 12 is a view similar to that of FIG. 11, but showing the slots in the sleeves in another nonaligned position.

As shown in FIG. 11, the spacer 54 can be locked in place by simply rotating the outer sleeve 64 to a point where the outer sleeve slot 68 is no longer aligned with the inner sleeve slot 66 and then running in the bolt 80 securely against the inner sleeve 62. The spacer is illustrated in FIG. 11 after the outer sleeve has been rotated through 90°. If desired the outer sleeve can be further rotated until the set screw bolt, which in this case would be somewhat longer, as indicated by bolt 82, is aligned with the inner sleeve slot 66. This arrangement allows the bolt 82 to be threaded in until it is in secure contact with the polish rod itself. By this means the spacer would more readily be maintained in a centralized position.

It will now be appreciated that it is a simple matter to install the spacer and operate the well unit with the spacer attached. To replace the spacer with a transducer, all that is necessary is to stop the pumping unit, back off the set screw, rotate the outer sleeve to a point where the slots of the inner and outer sleeves are aligned, and remove the spacer. Any suitable transducer can then be installed in the space vacated by the spacer, care having been taken to make the spacer of a length equal to the length of the transducer to be used. This entire procedure will take only a very short time, in the order of about two minutes. This is significantly shorter than the time it normally takes to install a transducer under good conditions through available techniques and much shorter than it takes to install a transducer on a polish rod that has does not have adequate space to allow the polish rod clamp and attached polish rod to be raised a distance equal to the length of the transducer.

By not having to move the polish rod in order to take transducer readings, the pump plunger can be tested in its original position, thereby avoiding erroneous readings due to different conditions which may be encountered due to the different plunger positions.

The spacer of the invention is not only simple to use and allows a transducer to be installed in a short time, but is of a simple yet highly effective design that enables it to be fabricated quite economically.

It should now be understood that the invention is not necessarily limited to all the specific details described in connection with the preferred embodiment but that changes to certain features of the preferred embodiment which do not affect the overall basic function and concept of the invention may be made by those skilled in the art without departing from the spirit and scope of the invention, as defined in the appended claims.

What is claimed is:

1. A spacer mounted on a polish rod which is connected to a reciprocal rod string of a well unit having a rod clamp attached to the polish rod and a carrier bar located below the rod clamp, said spacer comprising:

means for vertically transmitting well unit operating loads;

means for allowing ready installation of the spacer on and removal of the spacer from the polish rod in order to expose a portion of the polish rod for mounting a load measuring means thereon, the portion of the polish rod covered by the spacer being substantially equal to the length of the load measuring means to be installed on the polish rod; and means for locking the spacer in place as mounted on the polish rod.

2. The spacer of claim 1, wherein the means for vertically transmitting well unit operating loads comprises upper and lower end plates connecting substantially vertically extending spacer wall means, each end plate being in contact with an adjacent load bearing surface mounted on the polish rod.

3. The spacer of claim 2, wherein the well unit includes a rod rotator between the spacer and the carrier bar, the upper end plate of the spacer engaging the polish rod clamp and the lower end plate of the spacer engaging the rod rotator.

4. The spacer of claim 2, wherein the well unit includes a rod rotator between the spacer and the polish rod clamp, the upper end plate of the spacer engaging the rod rotator and the lower end plate of the spacer engaging the carrier bar.

5. The spacer of claim 1, wherein the means for allowing ready installation of the spacer on and removal of the spacer from the polish rod comprises an inner sleeve and an outer sleeve rotatably mounted on the inner sleeve, the inner and outer sleeves each including a longitudinal slot having a width at least slightly greater than the diameter of the polish rod, whereby when the outer sleeve is rotated to a position substantially aligning the slots the sleeves can be moved transversely onto or removed from the polish rod, and when the outer sleeve is rotated to a position so that the slots are nonaligned the sleeves cannot be removed from the spacer rod.

6. The spacer of claim 5, wherein the means for vertically transmitting well unit operating loads comprises upper and lower end plates connected to the inner sleeve, the outer sleeve being at least slightly shorter than the inner sleeve to allow rotation of the outer sleeve with respect to the inner sleeve.

7. The spacer of claim 6, wherein said locking means fixes the outer sleeve in a position with respect to the inner sleeve whereby their slots are nonaligned.

8. The spacer of claim 1, wherein the locking means comprises a set screw extending through the outer sleeve into contact with the inner sleeve.

9. The spacer of claim 1, wherein the locking means comprises a set screw extending through the outer sleeve into contact with the polish rod.

10. A method of mounting load measuring means onto the polish rod of a well unit having a polish rod connected to a reciprocal rod string, a rod clamp attached to the polish rod and a carrier bar located below the rod clamp, comprising the steps of:

mounting a first spacer on the polish rod between the carrier bar and the polish rod clamp so that the portion of the polish rod covered by the first spacer is substantially equal to the length of the load measuring means to be installed on the polish rod;

operating the well unit, with the first spacer functioning to vertically transmit well unit operating loads;

relieving the load of the rod string from the carrier bar;

removing the first spacer from the polish rod after the step of relieving and without substantially moving the polish rod; and installing the load measuring means on the polish rod between the carrier bar and the polish rod clamp.

11. The method of claim 10, wherein the first spacer is caused to vertically transmit well unit operating loads by connecting upper and lower end plates to a substantially vertically extending wall portion of the first spacer, each end plate being in contact with an adjacent load bearing surface mounted on the polish rod.

12. The method of claim 11, wherein the well unit includes a rod rotator between the first spacer and the carrier bar, and the first spacer is mounted on the polish rod so that the upper end plate of the first spacer engages the polish rod clamp and the lower end plate of the first spacer engages the rod rotator.

13. The method of claim 11, wherein the well unit includes a rod rotator between the first spacer and the polish rod clamp, and the first spacer is mounted on the polish rod so that the upper end plate of the first spacer engages the rod rotator and the lower end plate of the first spacer engages the carrier bar.

14. The method of claim 10, wherein the first spacer comprises an inner sleeve and an outer sleeve rotatably mounted on the inner sleeve, the inner and outer sleeves each including a longitudinal slot having a width at least slightly greater than the diameter of the polish rod, the first spacer being mounted on the polish rod by rotating the outer sleeve to a position whereby the slot are substantially aligned and moving the sleeves transversely onto the polish rod, the first spacer being maintained on the polish rod by rotating the outer sleeve to a position whereby the slots are nonaligned, and the first spacer being removed by rotating the outer sleeve back to a position whereby the slots are substantially aligned and moving the sleeves transversely away from the polish rod.

15. The method of claim 14, wherein the first spacer functions to vertically transmit well unit operating loads by providing upper and lower end plates connected to the inner sleeve, each end plate engaging an adjacent load bearing surface, and the outer sleeve being at least slightly shorter than the inner sleeve to allow rotation of the outer sleeve with respect to the inner sleeve.

16. The method of claim 10, wherein the well unit includes a rod rotator mounted on the polish rod and wherein the load measuring means is inserted between the carrier bar and the rod rotator.

17. The method of claim 10 wherein the well unit has a liner nut and a stuffing box located below the carrier bar and the step of relieving the load of the rod string from the carrier bar comprises inserting a second spacer between the liner nut and the stuffing box.

18. A method of mounting load measuring means onto the polish rod of a well unit having a polish rod connected to a reciprocal rod string, a rod clamp attached to the polish rod and a carrier bar located below the clamp, comprising the steps of:

mounting a spacer on the polish rod in a position between the carrier bar and the polish rod clamp so that the portion of the polish rod covered by the spacer is substantially equal to the length of the load measuring means to be installed on the polish rod; locking the spacer in said position between the carrier bar and the polish rod clamp;

operating the well unit, with the spacer functioning to vertically transmit well unit operating loads;

unlocking and removing the spacer from the polish rod; and installing the load measuring means on the polish rod between the carrier bar and the polish rod clamp.

19. A spacer for insertion on a polish rod comprising:

(a) a top plate having a transversely extending slot;

(b) a bottom plate having a transversely extending slot;

(c) an inner sleeve having a longitudinal slot and being fixedly secured to said top plate and said bottom plate such that transversely extending slots and said longitudinal slot are substantially aligned;

(d) an outer sleeve rotatably mounted on said inner sleeve and having a longitudinal slot, the spacer capable of being moved onto or removed from the polish rod when said longitudinal slots are substantially aligned whereas the spacer cannot be inserted onto or removed from the polish rod when said longitudinal slots are not substantially aligned; and (e) locking means for locking the outer sleeve in a position with respect to the inner sleeve whereby said longitudinal slots are nonaligned.

20. The spacer of claim 19 wherein the locking means comprising a set screw extending through the outer sleeve into contact with the inner sleeve.

21. The spacer of claim 19 wherein the locking means comprising a set screw extending through the outer sleeve into contact with the polish rod.

* * * * *